US010704379B2

(12) United States Patent
Indo et al.

(10) Patent No.: US 10,704,379 B2
(45) Date of Patent: Jul. 7, 2020

(54) FLOWLINE SATURATION PRESSURE MEASUREMENTS

(71) Applicant: Schlumberger Technology Corporation, Sugar Land, TX (US)

(72) Inventors: Kentaro Indo, Sugar Land, TX (US); Julian Pop, Houston, TX (US); Maxim Yushko, Houston, TX (US); Tudor Ioan Palaghita, Houston, TX (US); Zeynep Alpman, Houston, TX (US); Alexis Petit, Dhahran (SA); Sepand Ossia, Cambridge, MA (US); Tullio Moscato, Clamart (FR)

( * ) Notice: Subject to any disclaimer, the term of this patent is extended or adjusted under 35 U.S.C. 154(b) by 273 days.

(21) Appl. No.: 15/678,141

(22) Filed: Aug. 16, 2017

(65) Prior Publication Data

US 2018/0051553 A1 Feb. 22, 2018

Related U.S. Application Data

(60) Provisional application No. 62/376,728, filed on Aug. 18, 2016.

(51) Int. Cl.

| | |
|---|---|
| ***E21B 49/08*** | (2006.01) |
| ***E21B 47/06*** | (2012.01) |
| ***E21B 49/10*** | (2006.01) |

(52) U.S. Cl.

CPC ..... *E21B 47/06* (2013.01); *E21B 49/081* (2013.01); *E21B 49/10* (2013.01); *E21B 2049/085* (2013.01)

(58) Field of Classification Search

CPC ..... E21B 49/081

USPC ..... 166/264

See application file for complete search history.

(56) References Cited

U.S. PATENT DOCUMENTS

| | | | | |
|---|---|---|---|---|
| 5,329,811 | A | 7/1994 | Schultz et al. | |
| 5,473,939 | A | 12/1995 | Leder et al. | |
| 6,334,489 | B1 | 1/2002 | Shwe et al. | |
| 7,222,524 | B2 | 5/2007 | Shammai | |
| 7,346,460 | B2 | 3/2008 | DiFoggio et al. | |
| 7,461,547 | B2 | 12/2008 | Terabayashi et al. | |
| 7,774,141 | B2 | 8/2010 | Li | |
| 8,616,282 | B2 | 12/2013 | Moscato et al. | |
| 8,778,835 | B2 | 7/2014 | Hungenberg et al. | |
| 9,536,758 | B1 * | 1/2017 | Deo | H01L 21/324 |
| 2004/0231408 | A1 | 11/2004 | Shammai | |
| 2009/0188259 | A1 * | 7/2009 | Colja | B60N 2/5685 62/3.2 |
| 2011/0315375 | A1 * | 12/2011 | Moscato | G01F 1/684 166/250.01 |
| 2013/0068453 | A1 | 3/2013 | Al-Ajaji et al. | |

(Continued)

OTHER PUBLICATIONS

Artic TEC Technologies website: www.arctictec.com. Dortmund, Germany.

(Continued)

*Primary Examiner* — Taras P Bemko

(57) ABSTRACT

A method for sampling a downhole formation fluid includes pumping formation fluid into the flowline of a downhole sampling tool. The method can also include measuring a saturation pressure of the formation fluid in the flowline while pumping. The method can also include adjusting the pumping rate such that the fluid pressure in the flowline remains within a predetermined threshold above the measured saturation pressure.

8 Claims, 10 Drawing Sheets

(56) References Cited

U.S. PATENT DOCUMENTS

| | | | | |
|---|---|---|---|---|
| 2013/0219997 | A1 | 8/2013 | Sullivan et al. | |
| 2014/0096955 | A1 | 4/2014 | Indo et al. | |
| 2014/0268156 | A1 | 9/2014 | Smythe et al. | |
| 2017/0045591 | A1* | 2/2017 | Jelezko ..... | G01K 5/72 |
| 2017/0362936 | A1 | 12/2017 | Indo et al. | |

OTHER PUBLICATIONS

Wikipedia page of Thermoelectric Cooling technique: https://en.wikipedia.org/wiki/Thermoelectric_cooling.

* cited by examiner

FLOWLINE SATURATION PRESSURE MEASUREMENTS

CROSS REFERENCE TO RELATED APPLICATIONS

This application claims the benefit of, and priority to, U.S. Patent Application No. 62/376,728, filed Aug. 18, 2016 and titled "Flowline Saturation Pressure Measurements." The foregoing application is incorporated herein by this reference in its entirety.

FIELD OF THE INVENTION

Disclosed embodiments relate generally to sampling subterranean formation fluids and more specifically to a method and apparatus for measuring saturation pressures of fluid in the flowline of a downhole sampling tool.

BACKGROUND INFORMATION

In order to successfully exploit subterranean hydrocarbon reserves, information about the subsurface formations and formation fluids intercepted by a wellbore is generally required. This information may be obtained via sampling formation fluids during various drilling and completion operations. The fluid may be collected and analyzed, for example, to ascertain the composition and producibility of hydrocarbon fluid reservoirs.

In order to obtain a reliable characterization of the reservoir fluid, it is desirable to minimized drilling fluid contamination, for example, via pumping sampled fluid overboard until contamination levels reach an acceptably low level. Such a process can be time consuming as it sometimes requires pumping hundreds of liters of fluid overboard. Increasing the flow rate can be problematic as pumping too rapidly may reduce the flowline pressure below the saturation pressure of the fluid and thereby result in the formation of a second phase in the fluid (e.g., formation of gas bubbles or liquid condensate). Such bubble or dew formation can in turn decrease pumping efficiency and may further degrade optical spectroscopy measurements used to determine fluid contamination.

There is a need in the art for a method and apparatus for pumping formation fluid as rapidly as possible without drawing the flowline pressure below the saturation pressure of the fluid.

SUMMARY

A method for sampling a downhole formation fluid is disclosed. The method includes pumping formation fluid into the flowline of a downhole sampling tool, measuring a saturation pressure of the formation fluid in the flowline while pumping, and adjusting the pumping rate such that the fluid pressure in the flowline remains within a predetermined threshold above the measured saturation pressure. The saturation pressure may be measured in the flowline, for example, by heating or cooling formation fluid in the flowline while pumping, estimating a temperature of the fluid in the flowline while heating or cooling, evaluating the temperature estimates to determine a temperature indicative of bubble or dew formation in the flowline, and processing a flowline pressure, a reference temperature, the temperature indicative of bubble or dew formation, and a formation fluid model to compute the saturation pressure of the formation fluid at the reference temperature.

A downhole formation fluid sampling tool includes a fluid flowline deployed between a fluid inlet probe and a pump (i.e., upstream of the pump) and a fluid phase sensor deployed in the fluid flowline. The fluid phase sensor includes a temperature sensor and at least one of a heating element and a cooling element deployed on a substrate (such as a diamond substrate). The sampling tool may further include a controller configured to implement the above described method.

The disclosed embodiments may provide various technical advantages. For example, disclosed embodiments may improve the pumping speed of formation fluid sampling operations while maintaining the flowline pressure above the saturation pressure of the formation fluid. The disclosed embodiments may further enable substantially continuous measurements of the saturation pressure in the flowline and therefore provide for rapid evaluation and adjustment of fluid sampling pumping rates.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
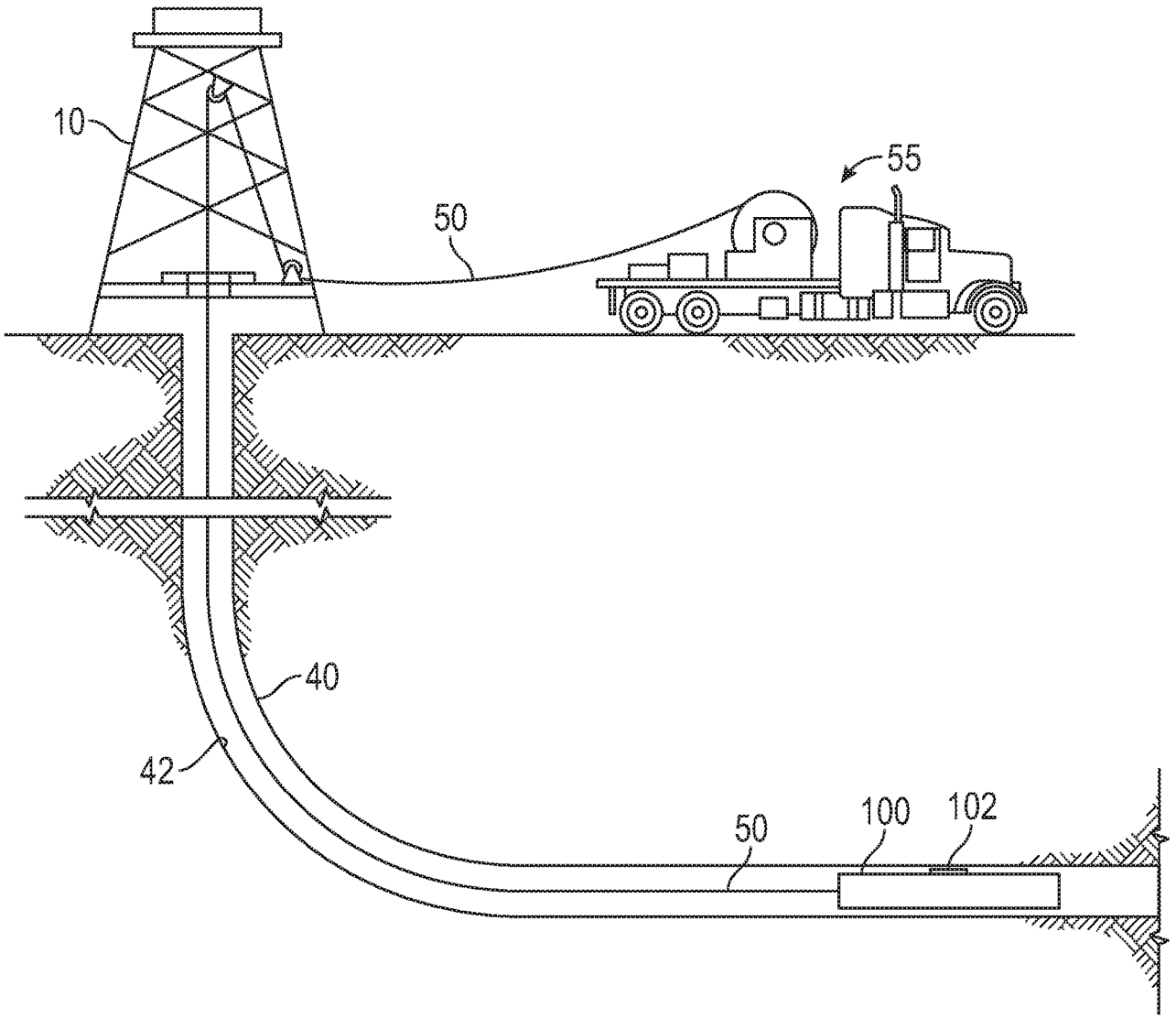
FIG. 1 depicts one example of a drilling rig on which disclosed sampling tool and method embodiments may be utilized.

FIG. 1 depicts a drilling rig 10 suitable for employing certain downhole tool and method embodiments disclosed herein. In the depiction, a rig 10 is positioned over (or in the vicinity of) a subterranean oil or gas formation (not shown). The rig may include, for example, a derrick and a hoisting apparatus for lowering and raising various components into and out of the wellbore 40. A downhole sampling tool 100 is deployed in the wellbore 40. The sampling tool 100 may be connected to the surface, for example, via a wireline cable 50 which may in turn be coupled to a wireline truck 55.

During a wireline operation, for example, sampling tool 100 may be lowered into the wellbore 40. In a highly deviated borehole, the sampling tool 100 may alternatively or additionally be driven or drawn into the borehole, for example, using a downhole tractor or other conveyance means. The disclosed embodiments are not limited in this regard. For example, sampling tool 100 may also be conveyed into the borehole 40 using coiled tubing or drill pipe conveyance methodologies. The sampling tool 100 may alternatively be deployed in a drill string for use in a "while-drilling" sampling operation.

The example sampling tool 100 described herein may be used to obtain formation fluid samples from a subterranean formation. The sampling tool 100 may include a probe assembly 102 for establishing fluid communication between the sampling tool 100 and the subsurface formation. During a sampling operation, the probe 102 may be extended into contact with the borehole wall 42 (e.g., through a mud cake/layer). Formation fluid samples may enter the sampling tool 100 through the probe assembly 102 (e.g., via pumping or via formation pressure).

While the disclosed embodiments are not limited in this regard, the probe assembly 102 may include a probe mounted in a frame (the individual probe assembly components are not shown). The frame may be configured to extend and retract radially outward and inward with respect to the sampling tool body. Moreover, the probe may be configured to extend and retract radially outward and inward with respect to the frame. Such extension and retraction may be initiated via an uphole or downhole controller. Extension of the frame into contact with the borehole wall 42 may further support the sampling tool in the borehole as well as position the probe adjacent the borehole wall.

While FIG. 1 depicts a wireline sampling tool 100, it will be understood that the disclosed embodiments are not so limited. For example, as stated above, sampling tool 100 may include a drilling tool such as a measurement while drilling or logging while drilling tool configured for deployment on a drill string. The disclosed embodiments are expressly not limited to wireline embodiments.

Figure 2:
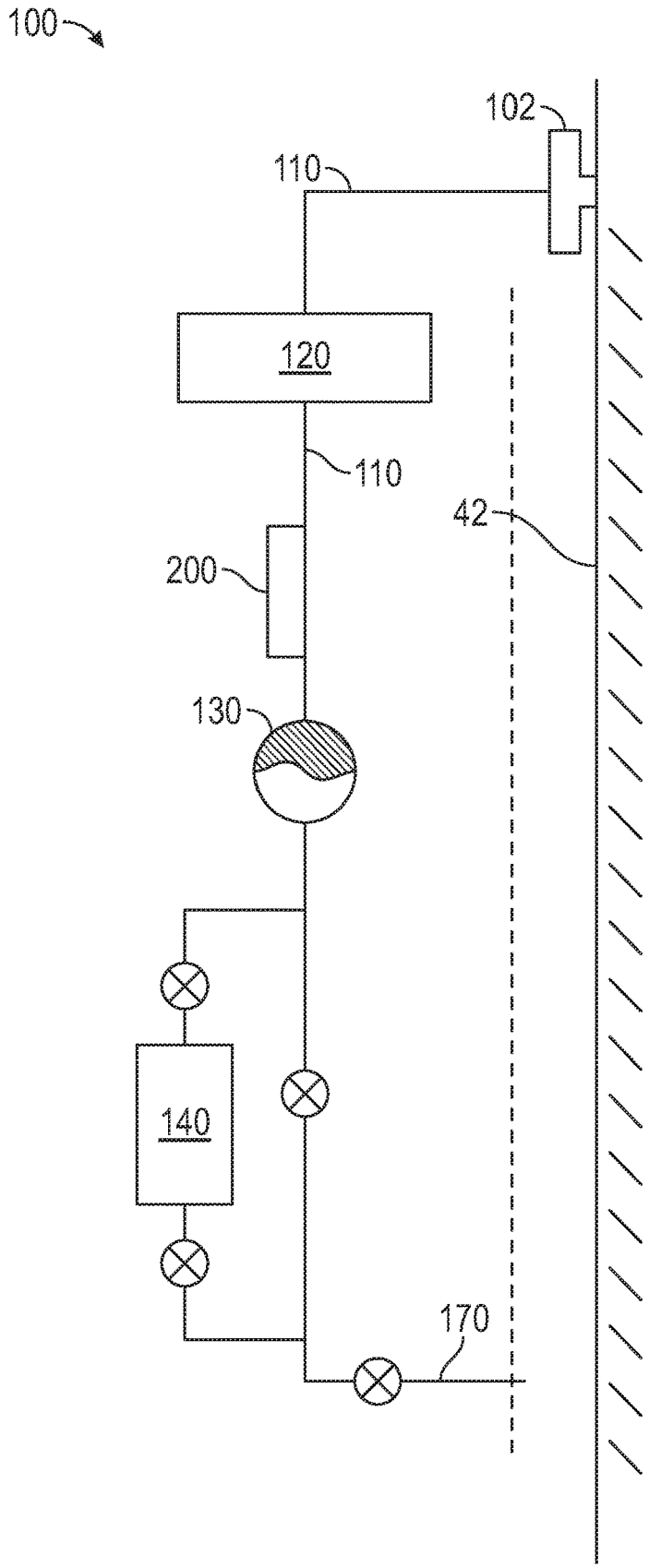
FIG. 2 depicts a downhole sampling tool including a schematic fluid flow circuit diagram.

FIG. 2 further depicts sampling tool 100 including a schematic fluid flow circuit diagram. As described above with respect to FIG. 1, the probe 102 is depicted as being in contact with the borehole wall 42 for obtaining a formation fluid sample. The probe 102 is in fluid communication with a primary flow line 110, which is in further communication with a fluid phase sensor 200, a fluid analysis module 120, and a pump 130. A sample vessel 140 is also in fluid communication with the primary flow line 110 and may be configured to receive a formation fluid sample. Sampling tool 100 further includes a fluid outlet line 170 configured for discharging unwanted formation fluid into the annulus or into the subterranean formation.

Fluid analysis module 120 may include substantially any suitable fluid analysis sensors and/or instrumentation, for example, including chemical sensors, optical fluid analyzers, optical spectrometers, nuclear magnetic resonance devices, a conductivity sensor, a temperature sensor, a pressure sensor. More generally, module 120 may include substantially any suitable device that yields information relating to the composition of the formation fluid and other properties, such as the thermodynamic properties of the fluid, conductivity, density, viscosity, pressure, temperature, and phase composition (e.g., liquid versus gas composition or the gas content). While not depicted, it will be understood that fluid analysis module 120 and fluid phase sensor 200 may alternatively and/or additionally be deployed on the downstream side of the pump 130, for example, to sense fluid property changes that may be induced via pumping.

Substantially any suitable sample vessel 140 may be utilized. The vessel may optionally include a piston that defines first and second chambers (not shown) within the vessel. As described in more detail below, the fluid phase sensor 200 may include a diamond substrate having at least one heating element and at least one temperature sensor deployed thereon. The fluid phase sensor 200 is preferably deployed on the upstream side of the pump 130 as depicted.

Figure 3:
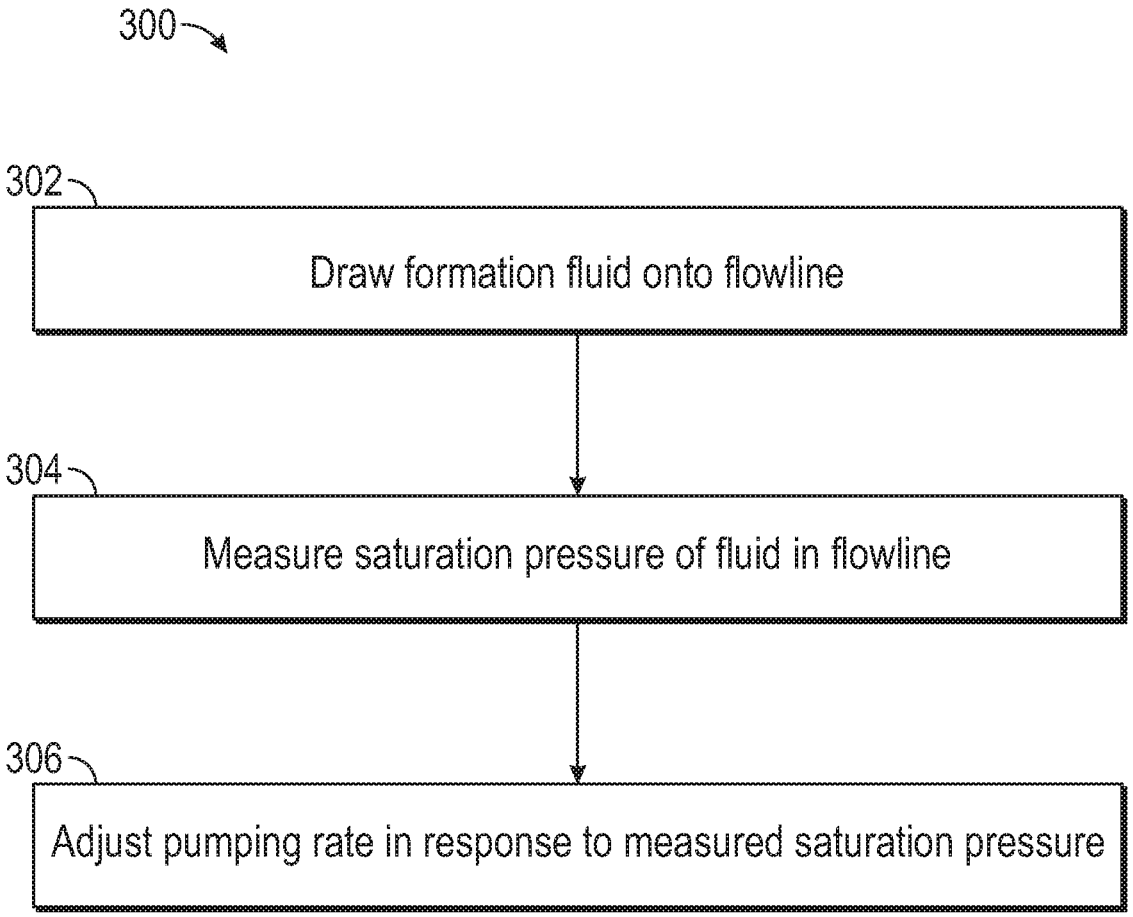
FIG. 3 depicts a flow chart of one disclosed method embodiment.

FIG. 3 depicts a flow chart of one disclosed method embodiment 300 for obtaining a formation fluid sample. At 302, formation fluid is drawn into the flowline of a downhole sampling tool (e.g., flowline 110 of sampling tool 100 depicted on FIGS. 1 and 2). While drawing/pumping fluid 302, the saturation pressure of the fluid in the flowline may be measured at 304 using a fluid phase sensor (e.g., fluid phase sensor 200) deployed on the flowline 310. It will be understood that the term saturation pressure may include the bubble point pressure and/or the dew point pressure of the fluid. The measurements may optionally be made substantially continuously, for example, at a measurement rate in a range from about 1 measurement per minute to about 1 measurement per second. The pumping rate may be adjusted at 306 in response to the saturation pressure value(s) measured at 304. The pumping rate is preferably adjusted such that the pressure in the flowline remains within a predetermined threshold above the measured saturation pressure. In certain embodiments the threshold may be determined, for example, via computing a saturation pressure uncertainty $\delta_{dP}$ as described in more detail below.

As described above in the Background Section of this disclosure, sampled formation fluid is commonly discharged (e.g., via discharge port 170) until contamination levels (e.g., as measured using fluid analysis module 120) decrease below a predetermined acceptable level. Such contamination removal procedures commonly require a large volume of formation fluid to be pumped and discharged, which can be time consuming and expensive. It is therefore generally desirable to pump the formation fluid as rapidly as possible. However, increasing the pumping rate draws down the fluid pressure in the flowline upstream of the pump (e.g., upstream of pump 130 in FIG. 2), which may in turn cause gas bubbles or liquid condensate to form if the pressure in the flowline drops below the saturation pressure of the fluid.

The emergence of a second phase fluid (e.g., gas bubbles in oil or liquid condensate in a retrograde gas) is generally undesirable for a number of reasons. For example, formation fluid containing a second phase fluid may not be representative of the original virgin fluid. Moreover, the presence of the second phase fluid may change the compressibility of the fluid and thereby reduce pumping efficiency. The presence of gas bubbles or liquid condensate may also degrade the reliability of optical spectroscopy measurements used to monitor fluid contamination due to scattering.

Method 300 is intended to optimize the pumping speed such that a low contamination formation fluid sample may be obtained in a timely manner without drawing the flowline pressure below the saturation pressure of the fluid.

Figure 4:
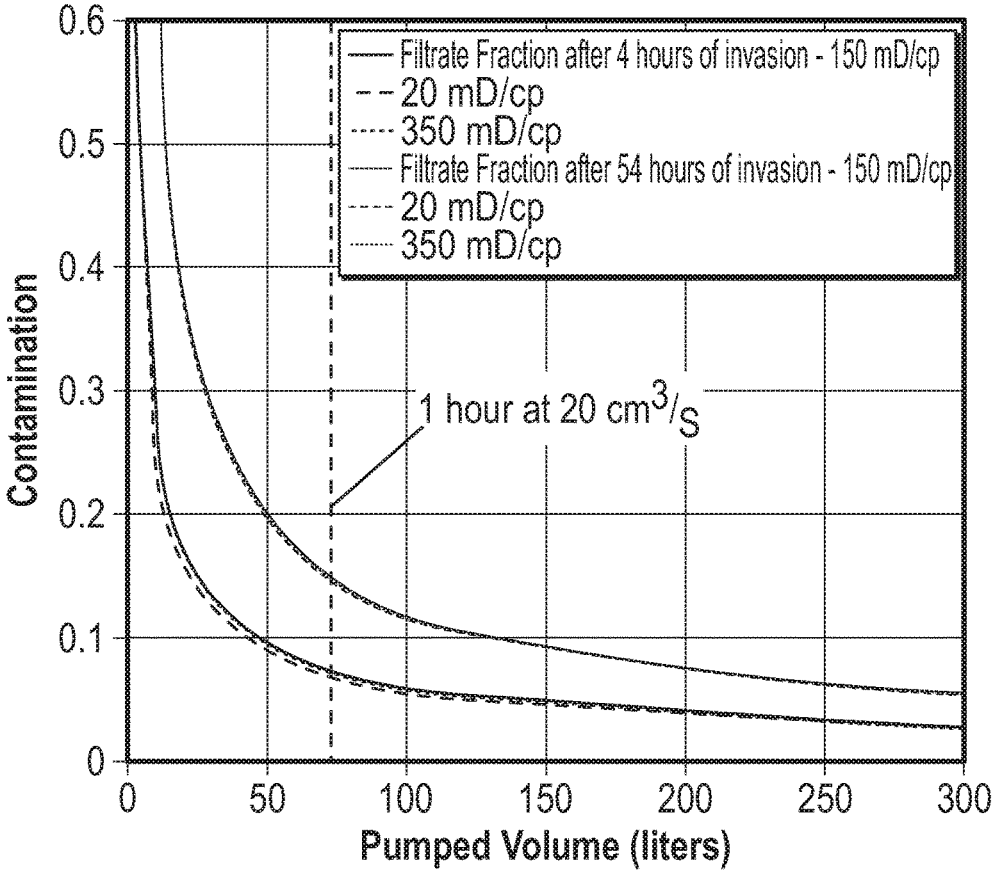
FIG. 4 depicts a plot of formation fluid contamination level versus pumped fluid volume during a sampling operation.

FIG. 4 depicts a plot of formation fluid contamination level (as a volume fraction) versus pumped volume of fluid during a sampling operation. Contamination levels are known to decrease approximately exponentially with pumped volume independent of the pumping speed (flow-rate) and mobility of the fluid. Increased pumping is generally required with increasing invasion (note that contamination levels are significantly higher after 54 hours of invasion as compared to 4 hours of invasion).

Figure 5:
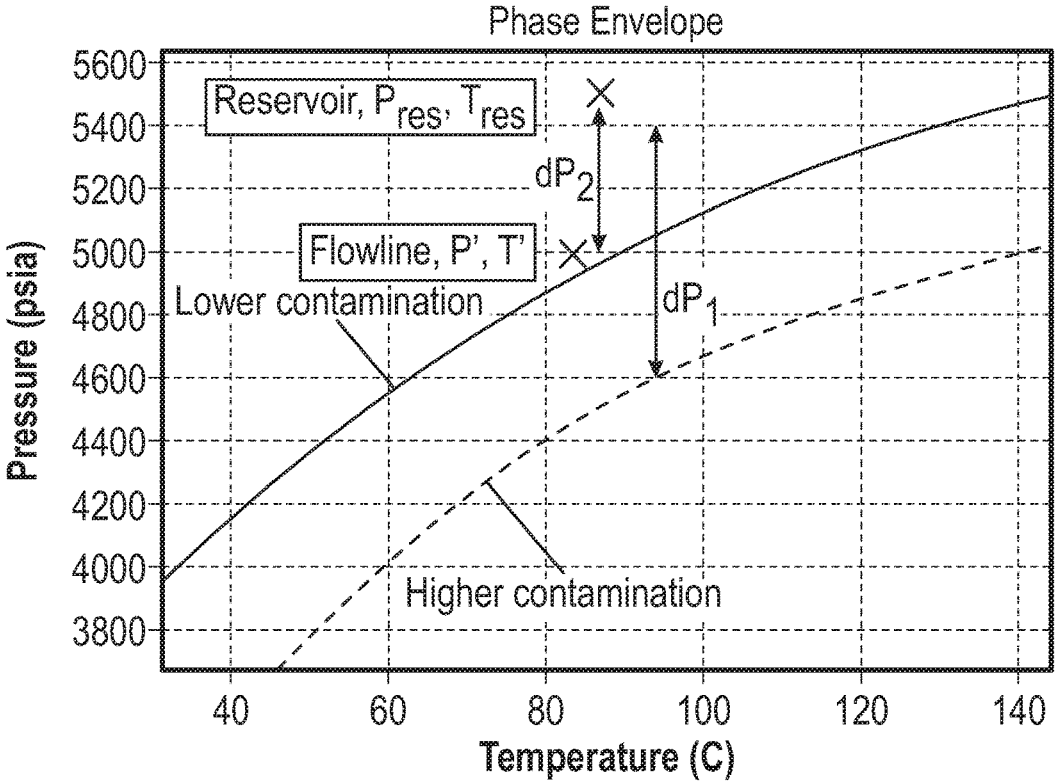
FIG. 5 depicts a portion of a pressure versus temperature phase envelope of an example crude oil sample.

FIG. 5 depicts a portion of a pressure versus temperature phase envelope of an example crude oil sample. As depicted, the saturation pressure (also referred to in the art as the bubble point pressure for an oil or the dew point pressure for a retrograde gas) depends on temperature and the contamination level of the fluid. The solid line indicates the phase boundary of the crude oil having a relatively low contamination level, whereas the dashed line indicates the saturation pressure of crude oil having a relatively high contamination level. For crude oil samples, the saturation pressure tends to be inversely related to the contamination level (i.e., decreasing with increasing contamination and increasing with decreasing contamination as depicted).

As described above it is desirable to maintain the flowline pressure above the saturation pressure to ensure a single phase fluid in the flowline (e.g., with no gaseous components in a liquid sample). Initially, the pumping speed (the flow rate) may be high since the contamination level is initially high and thereby allows for a higher drawdown pressure $dP_1$ between the reservoir pressure and the saturation pressure. As pumping progresses and the contamination level decreases (e.g., as depicted on FIG. 4), it may be necessary to decrease the pumping speed to reduce the drawdown pressure (e.g., to $dP_2$) and avoid bubble formation. During a conventional sampling operation, the saturation pressure of the flowline fluid is generally unknown and continuously changing as contamination decreases. Moreover, as depicted on FIG. 4, the contamination levels may initially decrease very rapidly (e.g., exponentially). Real time, rapid saturation pressure measurements at 304 may enable the pumping rate to be continually adjusted and optimized at 306 such that a maximum pumping rate is achieved without causing the flowline pressure to drop below the saturation pressure.

Figure 6:
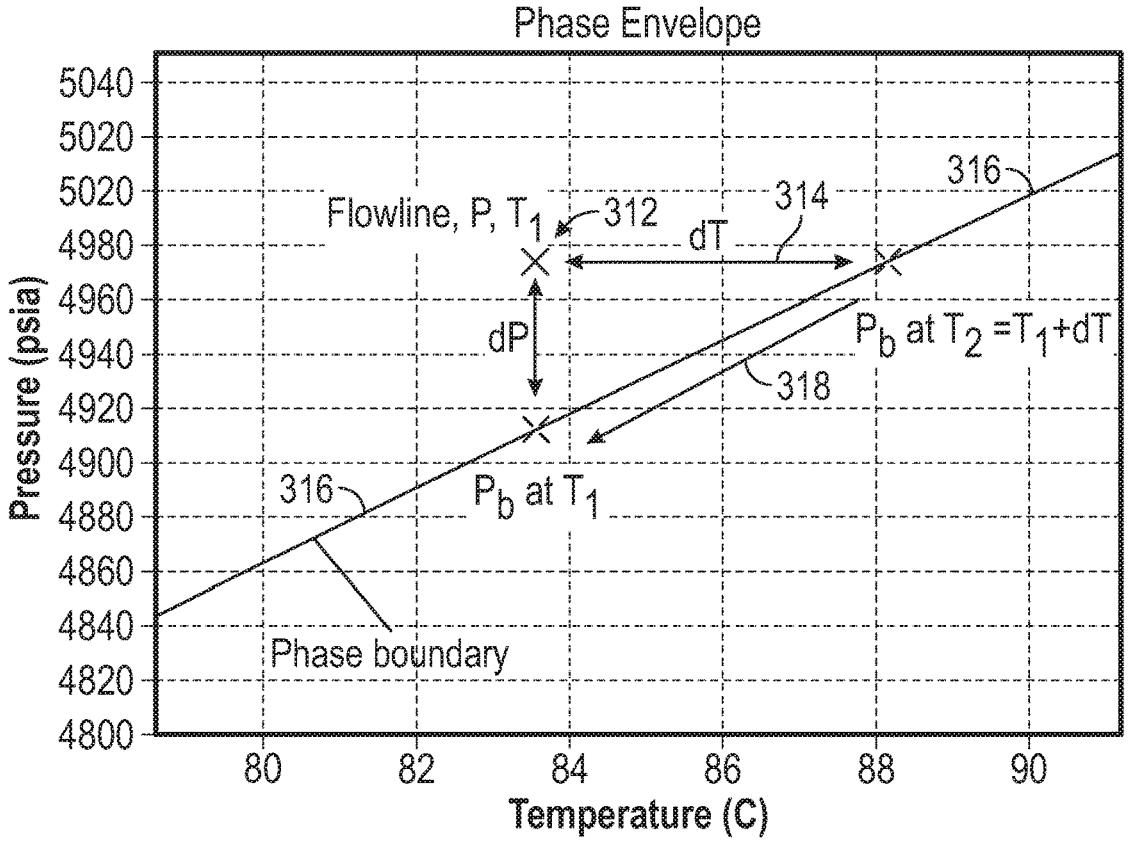
FIG. 6 plots a portion of the pressure-temperature phase envelope of an example crude oil sample and further illustrates one disclosed method embodiment.

Example measurement of the saturation pressure of the formation fluid at 304 in FIG. 3 is described in more detail with respect to FIG. 6 which plots a portion of the pressure-temperature phase envelope of an example crude oil sample. The temperature $T=T_1$ and pressure P of the flowline fluid is depicted at 312. These parameters may be measured while pumping, for example, using reference temperature and pressure sensors deployed in fluid analysis module or elsewhere in the flowline. The saturation pressure $P_b$ of the formation fluid may be measured at 304, for example, by (i) locally heating the flowline fluid (e.g., using the heating element in the fluid phase sensor 200) until bubbles are formed, (ii) determining a temperature indicative of bubble formation, e.g., the temperature $T_2=T_1+\Delta T$ at which the saturation pressure $P'_b$ is equal to the flowline pressure P (i.e., such that $P'_b=P$ at $T_2$) and (iii) processing $P'_b$ and $T_2$ in combination with a fluid model to compute the unknown saturation pressure $P_b$ at temperature $T_1$.

With continued reference to FIG. 6, local heating of the flowline fluid is depicted at 314. Note that the flowline fluid may be heated at 314 until the temperature crosses (or reaches) the phase boundary 316 at which point bubble formation may be observed. The temperature $T_2=T_1+\Delta T$ at which bubbles form is the temperature at which the phase boundary intersects the flowline fluid pressure P (i.e., when the saturation pressure $P'_b$ is equal to the flowline fluid pressure P) and may be measured using the temperature sensor in the fluid phase sensor. The unknown saturation pressure $P_b$ of the flowline fluid at the flowline temperature $T_1$ may then be computed at 318 via processing $P'_b$ and $T_2$ in combination with a fluid model.

Various formation fluid models are known in the art. For example, in one embodiment, the phase boundary of crude oils may be described mathematically using an empirical linear regression model including second order terms, for example, as follows:

$$f(T, \{x_i\}) = a_T T + b_T T^2 + \sum_i a_i x_i + \sum \sum_{i \le j} b_{ij} x_i x_j \tag{1}$$

where f(•) represents an estimated saturation pressure as a function of temperature T and fluid compositional inputs $\{x_i\}$ and $a_i$ and $b_{ij}$ represent coefficients which are calibrated against a fluid library, where $i,j \in CO_2, C_1, C_2, C_3, C_4, C_5, C_{6+}$ (with $C_1$, $C_2$ . . . representing methane, ethane, etc).

The difference in saturation pressure dP between the first and second temperatures $T_1$ and $T_2$ may be derived from Equation 1, for example, as follows:

$$dP(T_1,T_2)=f(T_2,\{x_i\})-f(T_1,\{x_i\})=a_T dT+b_T[2T_1 dT+dT] \tag{2}$$

where $dT=T_2-T_1$. An uncertainty $\delta_{dP}$ of the estimated saturation pressure difference dP tends to be related to uncertainty in the coefficients $a_T$ and $b_T$ and may therefore be quantified using a covariance matrix, for example, as follows:

$$\delta_{dP}^2 \approx x \mathrm{cov}(a_T, b_T) x^T \tag{3}$$

where $x=[dT, 2T_1 dT+dT^2]$ and $x^T$ represents the transpose of x.

With continued reference to FIGS. 3 and 6, the saturation pressure decrement dP and its relative uncertainty $\delta_{dP}$ may be estimated, for example, using Equations 2 and 3. Thus the saturation pressure at $T_1$ may be estimated, for example, as follows:

$$P_b(T_1)=P-dP\pm\delta_{dP} \tag{4}$$

where $P_b$ $(T_1)$ represents the saturation pressure at temperature $T_1$ ($P_b$ in FIG. 6) and P represents the pressure in the flowline (also $P'_b$ in FIG. 6).

Figure 7:
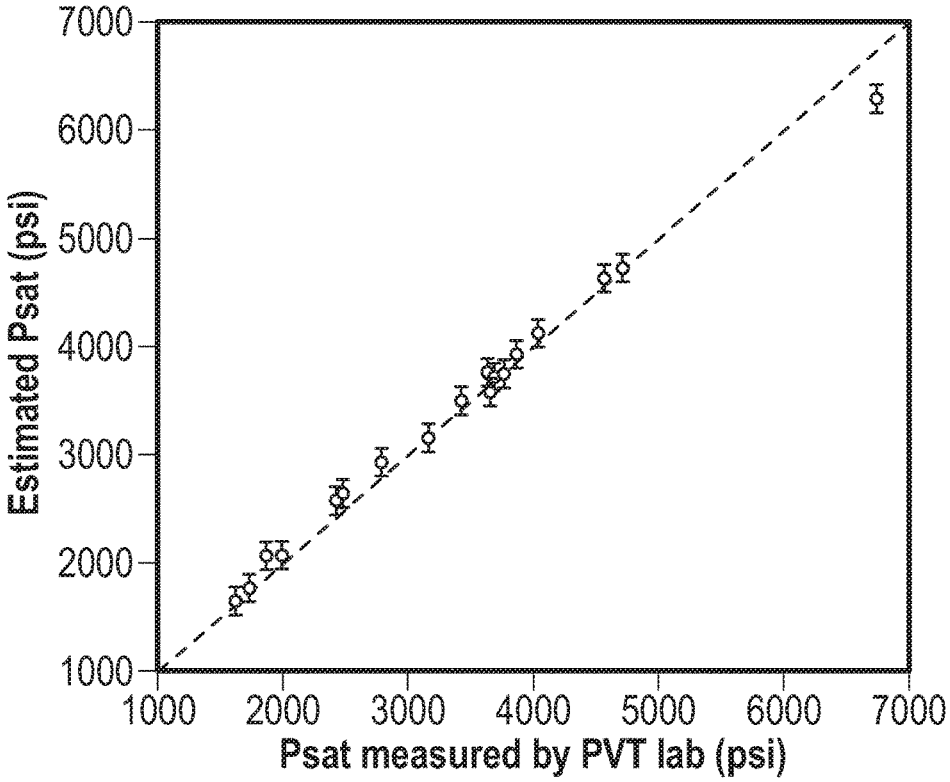
FIG. 7 depicts a plot of example estimated saturation pressures versus laboratory saturation pressure measurements using various types of crude oils.

FIG. 7 depicts a plot of the saturation pressure estimated via Equation 4 versus the saturation pressure derived from laboratory measurements using various types of crude oils having saturation pressures that range from about 2000 to about 6700 psi at 75 degrees C. and single-stage flash gas oil ratios ranging from about 160 to 3000 standard cubic feet per stock tank barrel (scf/stb). In this example, the saturation pressure at $T_2$ was measured in the laboratory and the saturation pressure at $T_1$ was estimated using the methodology described above where a difference between the flowline temperature $T_1$ and temperature after heating $T_2$ was arbitrarily set to 50 degrees centigrade (such that dT=50 degrees). Note the excellent fit between the saturation pressure values estimated using Equation 4 and those obtained via laboratory measurements. FIG. 7 also depicts the uncertainties associated with each estimate computed according to Equation 3.

Figure 8:
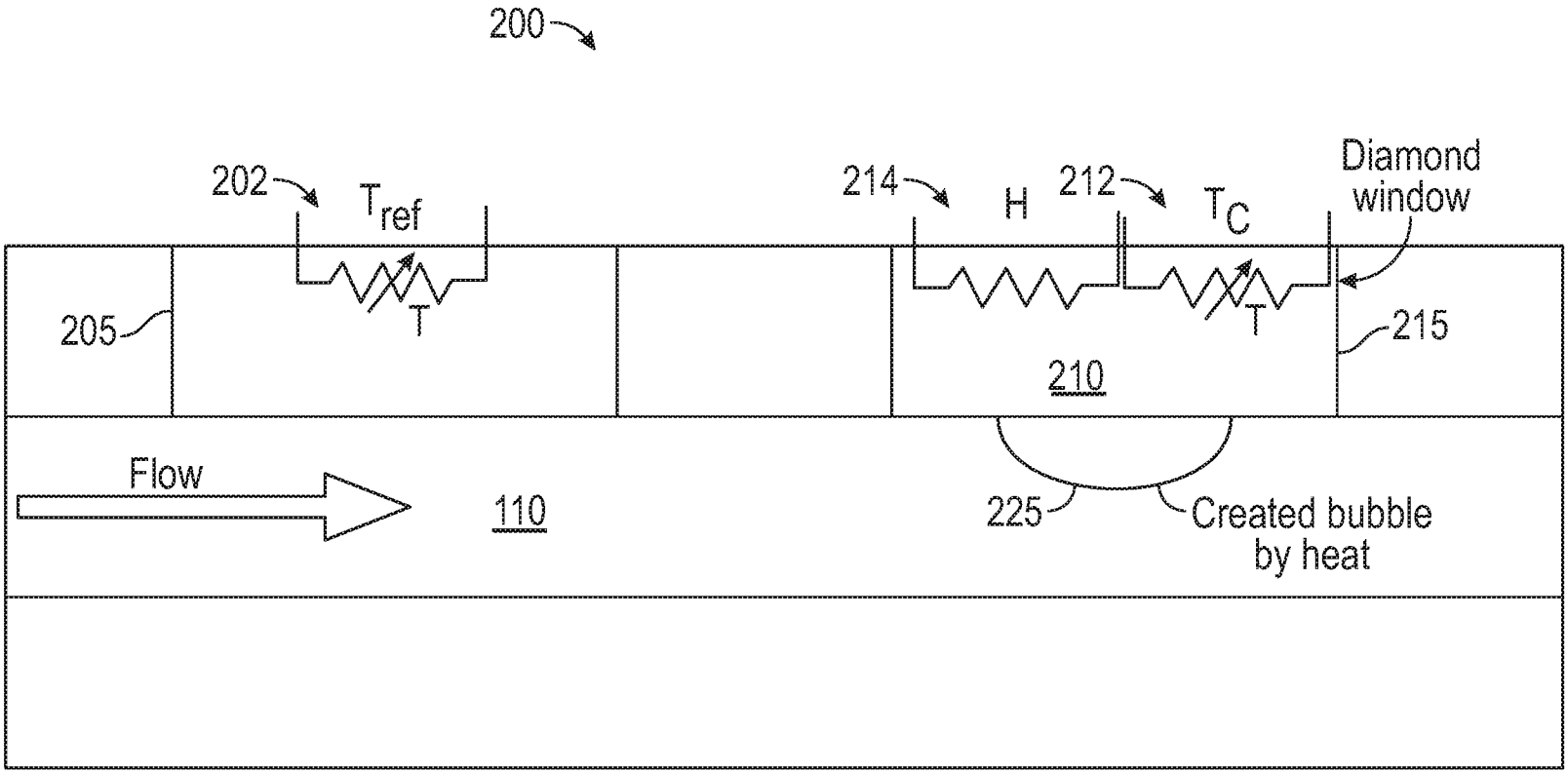
FIG. 8 depicts one example embodiment of the fluid phase sensor shown on FIG. 2.

FIG. 8 depicts one example embodiment of the fluid phase sensor 200 described above with respect to FIG. 2. As depicted, the sensor 200 may be deployed in/on the flowline 110. In the depicted embodiment, the fluid phase sensor includes first and second temperature sensors 202 and 212 and a heater element 214. Temperature sensor 202 (also referred to as a reference temperature sensor) is deployed upstream of temperature sensor 212 and heating element 214 and is optional. In the depicted embodiment, temperature sensor 212 and heating element 214 are packaged as a single element 210. Suitable sensors and heating elements are disclosed in U.S. Pat. No. 8,616,282, which is incorporated by reference in its entirety herein.

In certain embodiments, sensors 202, 212, and element 214 may be deployed, for example, on corresponding diamond substrates 205 and 215. The use of a diamond substrate may be advantageous owing to the high thermal conductivity of diamond and its mechanical strength against high pressure and high temperature fluids in the flowline.

During a formation fluid sampling operation, sensor 202 may be used to measure the reference temperature of the fluid in the flowline. Heating and sensing by heater 214 and sensor 212 may be carried out simultaneously. A suitable heating sequence may make use of AC, DC, and/or pulsed electrical current (the disclosed embodiments are not limited in this regard). The temperature reading $T_c$ at sensor 212 will be understood to depend on the local thermal properties of the system, including the thermal conductivity and heat capacity of the flowline fluid, and the fluid flow rate. Upon bubble formation (when the temperature has increased sufficiently to form a bubble in the flowline, for example, as depicted at 225 and as described above with respect to FIG. 6), the heat transfer coefficient between the diamond substrate and the flowline fluid tends to decrease, thereby resulting in an increase in $T_c$. Bubble formation may thus be readily detected via a measured temperature profile at sensor 212.

It will be understood that in other embodiments, the sampling tool 100 may further (or alternatively) include a thermoelectric cooling element for cooling the formation fluid in the flowline. When sampling retrograde gas samples, such cooling may induce condensation of liquid (dew) in the flowline (as the fluid cools from a single phase gas or gas condensate regime into a two phase regime) and thereby enable the saturation pressure to be determined in a manner similar to that described above.

Figure 9:
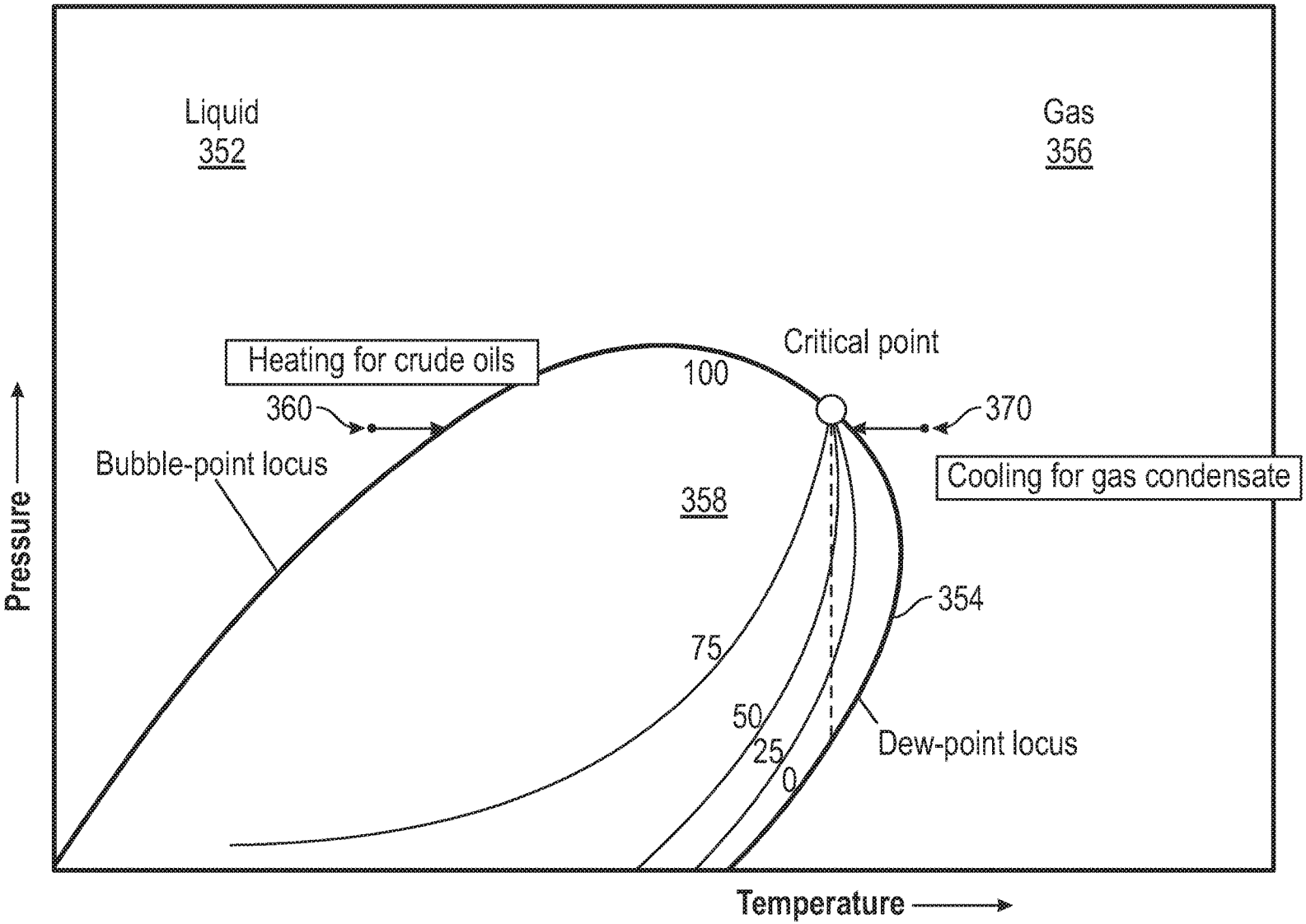
FIG. 9 depicts an example pressure versus temperature phase diagram for a subterranean formation fluid including liquid, gas condensate, and gas phases.

FIG. 9 depicts an example pressure versus temperature phase diagram for a subterranean formation fluid including liquid 352, retrograde 354, and gas 356 phases. A two-phase regime 358 (including both gas and liquid phases) is also depicted. The embodiments described above with respect to FIGS. 5-8, in which the sampled fluid is heated in the flowline, relate to sampling liquid phase (oil) formation fluids in which heating the fluid may cause bubble formation (e.g., as depicted at 360). In other embodiments a retrograde gas (or gas condensate) sample may be cooled in the flowline (as shown at 370) to induce condensation of a liquid (dew) by which the saturation pressure (the dew point pressure) may be determined.

For example, the saturation pressure of the formation fluid may be measured by (i) locally cooling flowline fluid (e.g., using a thermoelectric cooling element as described in more detail below) until the fluid temperature in the flowline reaches or crosses the phase boundary between the dense phase 354 and two phase 358 regimes, (ii) determining a temperature indicative of liquid condensate formation, e.g., the temperature $T_2=T_1-\Delta T$ at which the saturation pressure is equal to the flowline pressure, and (iii) processing the flowline pressure and $T_2$ in combination with a fluid model to compute the unknown saturation pressure at temperature $T_1$ (the reference temperature).

Figure 10:
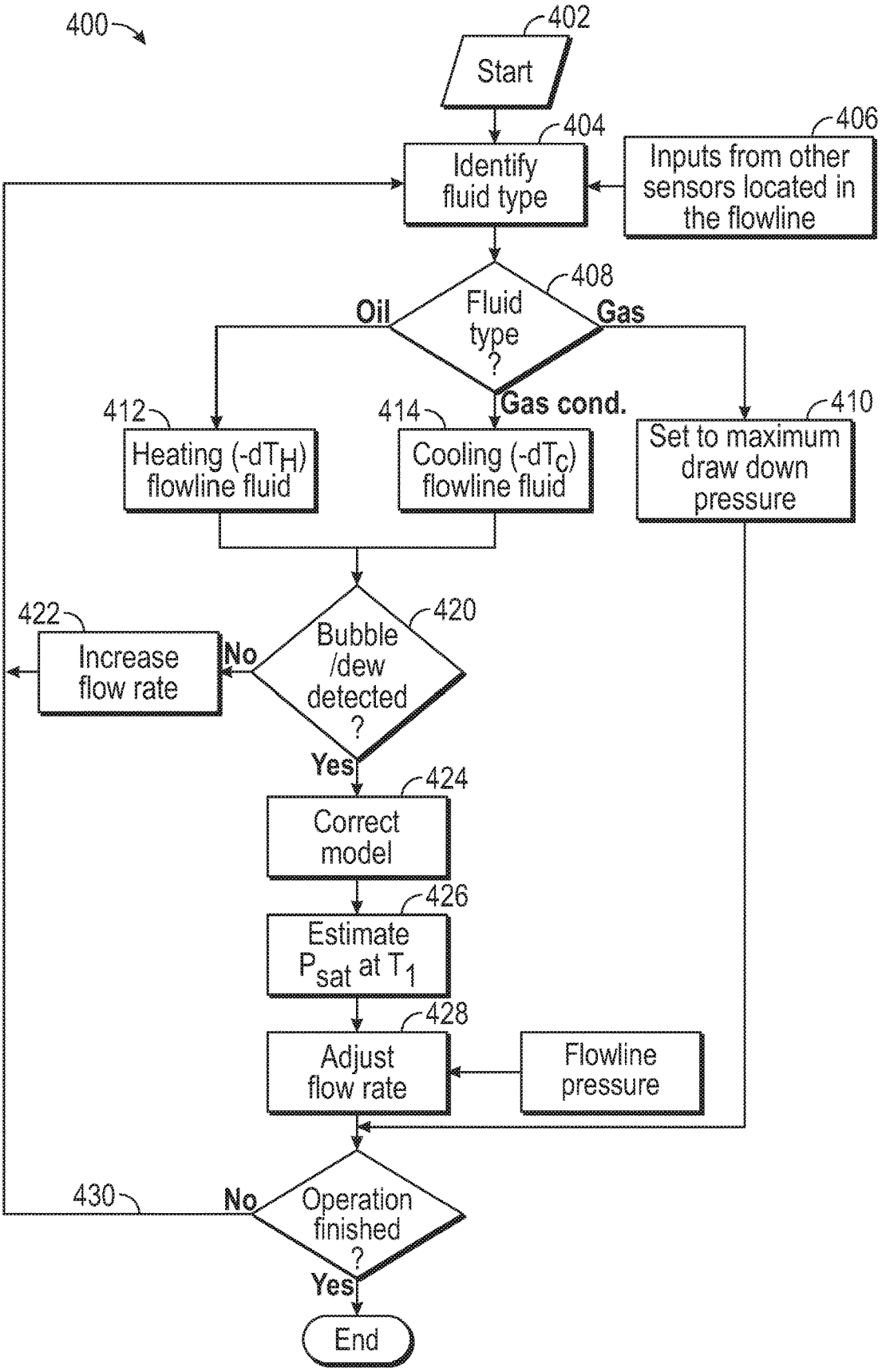
FIG. 10 depicts a flow chart of another disclosed method embodiment for obtaining a formation fluid sample.

FIG. 10 depicts a flow chart of another disclosed method embodiment 400 for obtaining a formation fluid sample. Method 400 is similar to method 300 in that formation fluid is drawn/pumped into the flowline of a downhole sampling tool (e.g., flowline 110 of sampling tool 100 depicted on FIGS. 1 and 2) at 402. As described above, the contamination level in the fluid may be changing continuously while pumping in 402. The formation fluid type is identified at 404, for example, using inputs from other sensors 406 located in fluid communication with the flowline (e.g., in fluid analysis module 120). In one embodiment, the fluid type may be identified as a liquid oil, a gas condensate, or a gas using optical absorbance spectroscopy, for example, using the optical absorbance technique as disclosed in U.S. Patent Publication 2014/0096955, which is incorporated by reference herein in its entirety.

When the formation fluid sample is identified at 408 as a gas, the flowrate may be set to the maximum drawdown pressure defined by specification of the pump at 410 since no phase boundary is expected in the vicinity of the reservoir temperature. When the formation fluid sample is identified at 408 as a liquid (oil), the fluid phase sensor 200' (FIG. 11) may be used to heat the flowline fluid (e.g., by +dT) at 412 as described above with respect to FIG. 6. When the formation fluid sample is identified at 408 as a gas condensate (retrograde gas), the fluid phase sensor 200' may be used to cool the flowline fluid (e.g., by −dT) at 414 as described above with respect to FIG. 9. It will be appreciated that the terms gas condensate and retrograde gas are sometimes used interchangeably in the art (and are therefore used interchangeably herein). Moreover, it will be further appreciated by those of ordinary skill in the art that the classification of reservoir fluids into categories such as gas (e.g., dry gas or wet gas), gas condensate, and oil (liquid) is not always a sharply defined classification and that there may be some overlap between adjacent categories.

The fluid phase sensor 200' evaluates whether or not a phase change has been detected at 420. For example, when the fluid sample is a liquid oil, the presence of gas bubbles is evaluated at 420. When the fluid sample is a gas condensate, the presence of liquid condensate or dew is evaluated at 420. In one embodiment, the fluid phase sensor measures the temperature $T_c$ (and optionally $T_{ref}$) at 420 to evaluate the presence of the second phase (bubble or dew). If no bubble or dew is detected (e.g., in a predetermined time window), the flow rate may be incrementally increased at 422. If a bubble or liquid condensate is detected at 420 (e.g., via a rapidly increasing or decreasing dT as described in more detail below with respect to FIG. 12), a fluid model is then selected at 424 based on the fluid type identified at 408. For example, when the fluid type is identified as a liquid oil, the model described above with respect to Equations 2-4 may be utilized. When the fluid is a gas condensate an alternative model may be utilized. The saturation pressure $P_{sat}$ may then be computed at 426 and the flow rate adjusted (e.g., downward) at 428 to avoid bubble or dew formation based on the computed saturation pressure $P_{sat}$ (so as to avoid crossing the phase boundary while pumping). The process may continue (as indicated at 430) until a suitable formation fluid sample has been acquired.

With continued reference to FIG. 10, it will be appreciated that the method 400 may be simplified for either a heating or cooling embodiment, for example, when the fluid type is known prior to beginning the sampling operation. In operations in which the formation fluid sample is known to be liquid oil, the sampled fluid may be heated in the flowline while pumping. The temperature of the flowline fluid may be measured/estimated while heating and the temperature measurements evaluated to detect whether or not a gas bubble has formed in the flowline. The pumping rate may be increased when no gas bubble(s) is/are detected. When a bubble is detected the temperature indicative of bubble formation may be determined and processed in combination with a flowline pressure, a reference temperature and a formation fluid model to compute the saturation pressure (the bubble point pressure) of the formation fluid at the reference temperature. The pumping rate may then be reduced when the computed saturation pressure is greater than the flowline pressure.

In operations in which the formation fluid sample is known to be retrograde gas, the sampled fluid may be cooled in the flowline while pumping. The temperature of the flowline fluid may be measured/estimated while cooling and the temperature measurements evaluated to detect whether or not dew has formed in the flowline. The pumping rate may be increased when no dew is/are detected. When dew is detected the temperature indicative of dew formation may be determined and processed in combination with a flowline pressure, a reference temperature and a formation fluid model to compute the saturation pressure (the dew point pressure) of the formation fluid at the reference temperature. The pumping rate may then be reduced when the computed saturation pressure is greater than the flowline pressure.

Figure 11:
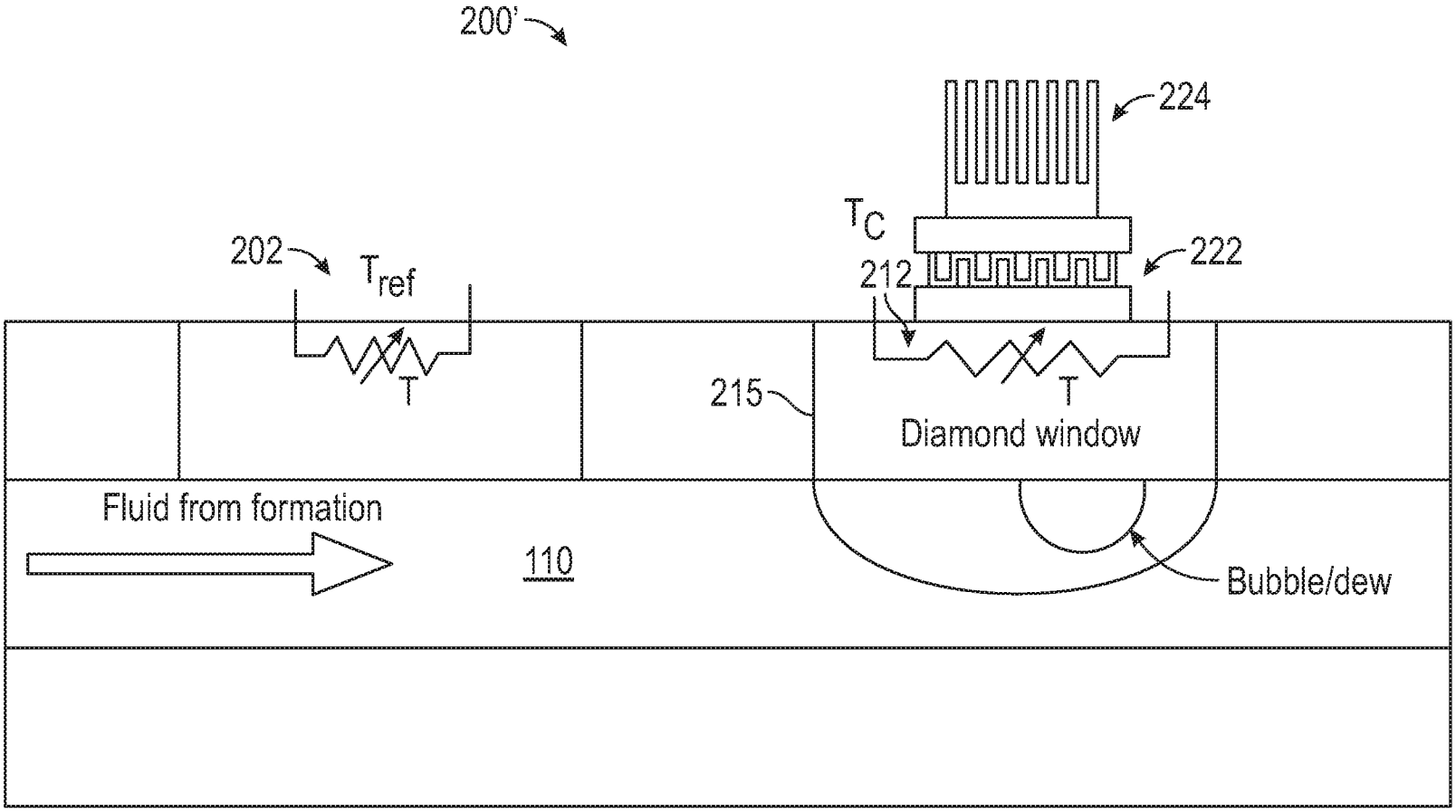
FIG. 11 depicts an example embodiment of a fluid phase sensor including a cooling element.

FIG. 11 depicts an example embodiment of a fluid phase sensor 200' including a cooling element 222. As depicted, the sensor 200' may be deployed in/on the flowline 110 (FIG. 2). Fluid phase sensor 200' is similar to sensor 200 (FIG. 8) in that it includes first and second temperature sensors 202 and 212 (with sensor 202 being optional). In the depicted embodiment, sensor 200' further includes a cooling element 222 deployed on substrate 215 (e.g., diamond substrate). The cooling element may be deployed, for example, on an outer surface of the substrate 215 external to temperature sensor 212 which, in the example embodiment depicted, is embedded in the substrate 215. Substantially any suitable cooling element may be utilized. For example, cooling element 222 may include a thermoelectric cooling element (also referred to in the art as a Peltier element) such as a single stage (as depicted) or multi stage thermoelectric module commercially available from Artic TEC Technologies (Dortmund, Germany, arctictec.com). Sensor 200' may optionally further include a finned heat sink 224 deployed on the cooling element 22 to promote heat dissipation and rapid cooling of the fluid in the flowline.

It will appreciated that fluid phase sensor 200' may further include a heating element such as heating element 214 in sensor 200 (FIG. 8). In such an embodiment, sampled formation fluid may be locally heated using heating element 214 or locally cooled using cooling element 222, for example, as described above with respect to FIG. 10, to form a gas bubble or liquid condensate (dew) in the flow line. The resistive temperature sensor 212 may also be used as a heating element in the depicted embodiment of sensor 200'. Moreover, in embodiments in which the cooling element 222 includes a thermoelectric cooling element, the cooling element may also be used as a heating element by reversing the electrical polarity.

Figure 12:
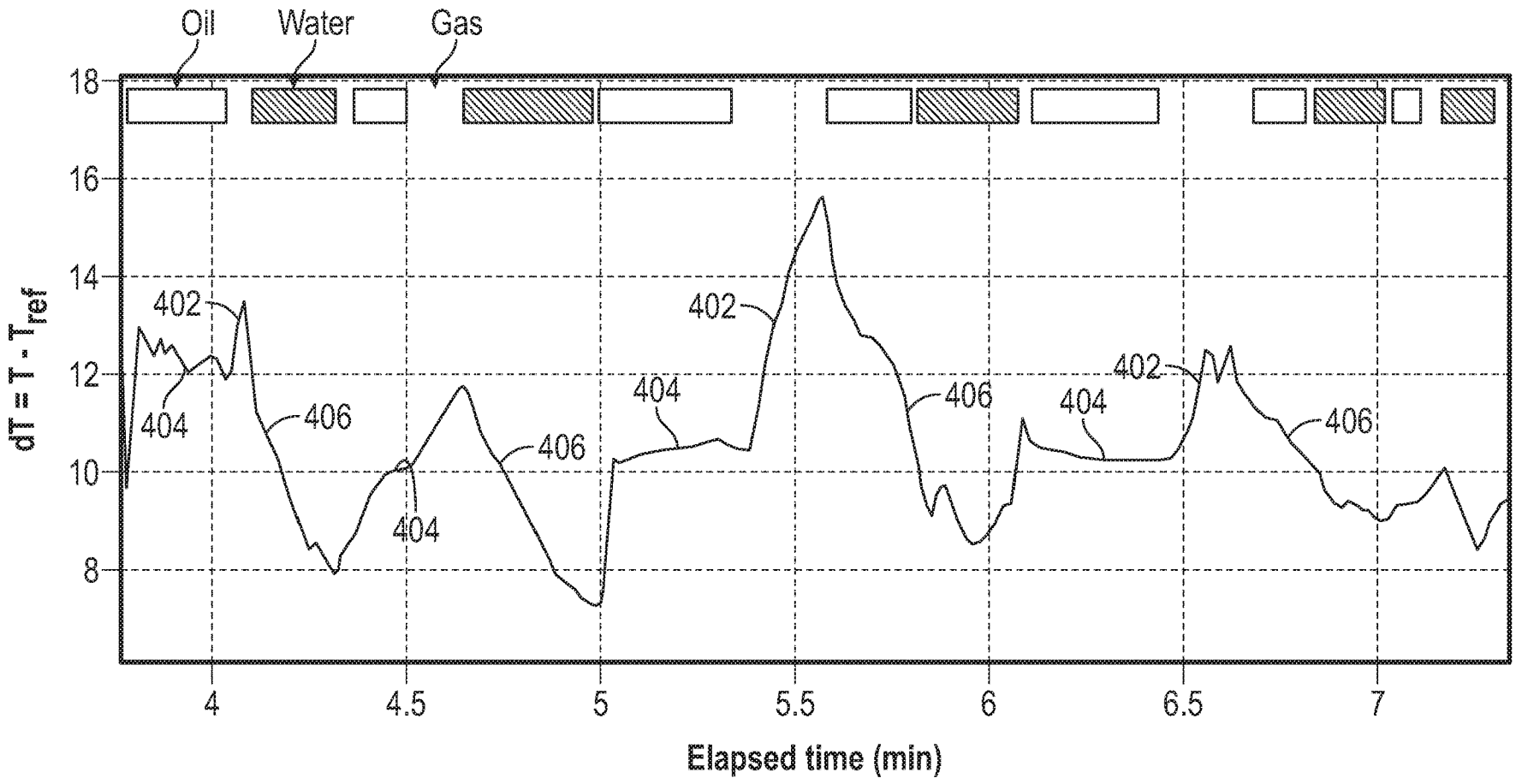
FIG. 12 plots one example of measured temperature sensor responses to different fluid types (oil, gas, and water) in a flowline.

FIG. 12 plots one example of temperature sensor responses to different fluid types (oil, gas, and water) in a flowline. The temperature difference $dT=T_c-T_{ref}$ (equivalently $dT=T_2-T_1$ as shown on FIG. 6 where $T_2=T_c$ and $T_1=T_{ref}$) is plotted versus time for an example sensor arrangement of the type depicted on FIG. 8. The fluid type (oil, gas, or water) is indicated at the top of the plot. In this example constant heat is applied to the flowing fluid. The temperature difference dT responds differently depending on the fluid type. While not wishing to be bound by theory, this effect is likely attributable to the heat transfer coefficients of the fluids which are related to the different thermal conductivity and heat capacity thereof. Note that the temperature difference dT tends to (i) increase (e.g., at 502) when the fluid is a gas, (ii) remain approximately constant (e.g., at 504) when the fluid is oil, and (iii) decrease when the fluid is water (e.g., at 506). By evaluating the temperature profile (e.g., a trend of dT with time) the sensor 200 may be capable of detecting the presence of gas bubbles in the above described methods.

It will be appreciated that a temperature profile (a trend of dT with time) may also be used to detect the presence of dew (liquid condensate) in cooling embodiments. Since the heat transfer coefficient of dew is generally higher than gas condensate, upon constant cooling the presence of dew on the substrate tends to cause an increase dT (and thus may be identified by an increasing temperature).

Although a flowline saturation pressure measurement method and apparatus and certain advantages thereof have been described in detail, it should be understood that various changes, substitutions and alternations can be made herein without departing from the spirit and scope of the disclosure as defined by the appended claims.

What is claimed is:

1. A downhole formation fluid sampling tool comprising:

a fluid flowline deployed between a fluid inlet probe and a pump; and a fluid phase sensor deployed in the fluid flowline, the fluid phase sensor including a temperature sensor and at least one of a heating element and a cooling element deployed on a substrate; and a controller configured to:

(i) cause the pump to pump formation fluid through the flowline;

(ii) cause the heating element to heat the formation fluid in the flowline or cause the cooling element to cool the formation fluid in the flowline while pumping in (i);

(iii) cause the temperature sensor to measure a temperature of the formation fluid in the flowline while heating or cooling in (ii);

(iv) evaluate said temperature measurements in (iii) to determine a temperature indicative of bubble formation or dew formation in the flowline;

(v) process a flowline pressure, a reference temperature, the temperature indicative of bubble formation or dew formation, and a formation fluid model to compute a saturation pressure of the formation fluid at the reference temperature; and (vi) adjust a rate of pumping in (i) such that a fluid pressure in the flowline remains within a predetermined threshold above the saturation pressure computed in (v).

2. The tool of claim 1, further comprising a reference temperature sensor deployed in the fluid flowline upstream of the fluid phase sensor.

3. The tool of claim 1, wherein the substrate is a diamond substrate.

4. The tool of claim 1, wherein the cooling element comprises a thermoelectric cooling element deployed on an external surface of the substrate.

5. The tool of claim 4, further comprising a heat sink deployed on an external surface of the thermoelectric cooling element.

6. The tool of claim 1, comprising both a heating element and cooling element deployed on the substrate.

7. The tool of claim 1, wherein the controller is configured to:

determine a saturation pressure of the formation fluid in the flowline while pumping in, and adjust a rate of pumping in (i) such that a fluid pressure in the flowline remains within a predetermined threshold above the determined saturation pressure.

8. A downhole formation fluid sampling tool comprising:

a fluid flowline deployed between a fluid inlet probe and a pump;

a fluid phase sensor deployed in the fluid flowline, the fluid phase sensor including a temperature sensor and at least one of a heating element and a cooling element deployed on a substrate; and a controller configured to:

(i) cause the pump to pump formation fluid through the flowline;

(ii) cause a fluid analysis module to identify the formation fluid as a gas condensate or a liquid;

(iii) cause the heating element to heat the formation fluid in the flowline when the formation fluid is identified as a liquid or cause the cooling element to cool the formation fluid in the flowline when the formation fluid is identified as a gas condensate;

(iv) cause the temperature sensor to measure a temperature of the formation fluid in the flowline while heating or cooling in (iii);

(v) evaluate said temperature measurements in (iv) to determine a temperature indicative of bubble formation or dew formation in the flowline;

(vi) process a flowline pressure, a reference temperature, the temperature indicative of bubble formation or dew formation, and a formation fluid model to compute a saturation pressure of the formation fluid at the reference temperature; and (vii) adjust a rate of pumping in (i) such that a fluid pressure in the flowline remains within a predetermined threshold above the saturation pressure computed in (vi).

* * * * *